United States Patent [19]

Dyckes et al.

[11] 4,386,767

[45] Jun. 7, 1983

[54] PORTABLE CLAMPING DEVICE

[76] Inventors: Dennis B. Dyckes, 5531 N. 66 St., Omaha, Nebr. 68104; Ross Johnson, 4339 Fowler Ave., Omaha, Nebr. 68111; Richard Hibbeler, 1616 Cuming St., Omaha, Nebr. 68102

[21] Appl. No.: 263,405

[22] Filed: May 14, 1981

[51] Int. Cl.[3] ..... B25B 1/02

[52] U.S. Cl. ..... 269/97; 269/152; 269/147; 269/204; 269/296; 269/901; 269/905; 269/252; 182/129

[58] Field of Search ..... 269/147–149, 269/204, 296, 905, 152, 155, 97–98, 252, 208, 203, 166, 167, 901, 95; 182/129, 181; 403/385, 391, 400

[56] References Cited

U.S. PATENT DOCUMENTS

| | | | |
|---|---|---|---|
| 443,317 | 12/1890 | Downing | 269/152 |
| 746,188 | 12/1903 | Sonsthayer | 403/385 |
| 1,408,301 | 2/1922 | Jeter | 269/147 X |
| 1,450,940 | 4/1923 | Cobb | 269/147 |
| 1,479,209 | 1/1924 | Topp | 269/208 |
| 1,769,511 | 7/1930 | Hestin et al. | 269/97 |
| 1,914,291 | 6/1933 | Reid | 269/147 X |
| 1,987,826 | 1/1935 | Heumann | 269/98 X |
| 2,756,789 | 7/1956 | Kraus et al. | 269/97 X |
| 3,843,110 | 10/1974 | Smith | 269/296 |
| 4,121,814 | 10/1978 | Prior | 269/296 |
| 4,330,113 | 5/1982 | Ferdinand et al. | 269/208 |
| 4,339,113 | 7/1982 | Vosper | 269/147 |

*Primary Examiner*—Robert C. Watson

*Attorney, Agent, or Firm*—Zarley, McKee, Thomte, Voorhees & Sease

[57] ABSTRACT

A portable clamping device is disclosed which utilizes conventional pipe clamps suspended between saw horses with pipe mounting device to provide a combination work table, bench vice, and gluing press. The device is adjustable in both size and shape. A pipe mounting device for mounting the pipe clamps on the saw horses is also described. The pipe mounting device consists of an annular pipe holder attached to a saw horse mounting bracket in either fixed or pivoting arrangement. Thumb screws are provided on both pipe holder and saw horse brackets.

6 Claims, 14 Drawing Figures

PORTABLE CLAMPING DEVICE

BACKGROUND OF THE INVENTION

The present invention relates generally to clamping devices used in carpentry and, more particularly, to a portable work bench clamping device.

When performing carpentry work, it is often necessary to apply pressure to a surface of a work piece to facilitate gluing or lamination. It is also necessary to hold a work piece in a fixed position for a number of carpentry operations, such as sawing, drilling, planing and the like. Well equipped carpentry shops usually have a number of devices for performing these holding functions, however, for carpenters operating in the field, or for do-it-yourself repairment, such workshop devices are generally unavailable, either because of expense or lack of portability.

A need exists for a portable device which provides a stable working surface and which allows a work piece to be firmly clamped into position for various carpentry operations. The device should be inexpensive to produce, easily transportable, and adaptable to working situations encountered in the field.

SUMMARY OF THE INVENTION

The present invention is a portable clamping device consisting of pipe clamps detachably mounted on saw horses. Horizontal pipes positioned between the saw horses create a stable work surface. A work piece may be laid across the pipes and locked into place by the pipe clamps, either for the purpose of providing pressure during lamination and the like, or for securely holding the piece at a convenient elevation for sawing, drilling or other carpentry operations.

Accordingly, it is an object of the present invention to provide a portable clamping device which may be used as a work bench.

It is a further object of the present invention to provide a portable clamping device with pipe mounting apparatus for mounting pipe clamps on saw horses.

It is a further object of the present invention to provide a portable clamping device which may hold a work piece in a fixed position for sawing or drilling operations.

It is a further object of the present invention to provide a portable clamping device which may support a work piece in a horizontal position on the pipe surfaces.

It is a further object of the present invention to provide a portable clamping device which may be used to hold a work piece positioned vertically against one of the pipes.

It is a further object of the present invention to provide a portable clamping device which may be used to stabilize the saw horses to form a rigid table.

It is a further object of the present invention to provide a portable clamping device with pivoting pipe mounting devices to allow the pipe clamps to be mounted in non-parallel relationship.

It is a further object of the present invention to provide a portable clamping device which utilizes pipe mounting devices equipped with hand turnable screws.

It is a further object of the present invention to provide a portable clamping device which has pipe clamps mounted to provide clamping in two planes.

It is a further object of the present invention to provide a portable clamping device which has pipe clamps mounted to provide clamping in three planes.

It is a further object of the present invention to provide a portable clamping device which has an open table area to allow access to a work piece from above and below.

It is a further object of the present invention to provide a portable clamping device which may be equipped with wood jaws mounted on the pipe clamps.

It is a further object of the present invention to provide a portable clamping device which may be used to hold thin sheets of paneling horizontally on the work surface to greatly reduce vibration during sawing.

It is a further object of the present invention to provide a portable clamping device which has the ability to clamp irregular shaped objects easily due to independent movement of pipe clamp jaws.

It is a further object of the present invention to provide a portable clamping device which is inexpensive to produce.

It is a further object of the present invention to provide a portable clamping device which is safe to operate.

It is a further object of the present invention to provide a portable clamping device which utilizes base supports, such as saw horses, which are readily available or easily constructed in the field.

DESCRIPTION OF THE PREFERRED EMBODIMENTS

Figure 1:
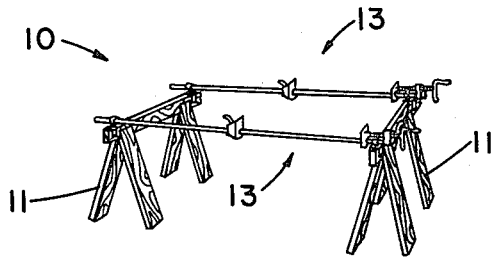
FIG. 1 is a perspective view of a portable clamping device.
Figure 2:
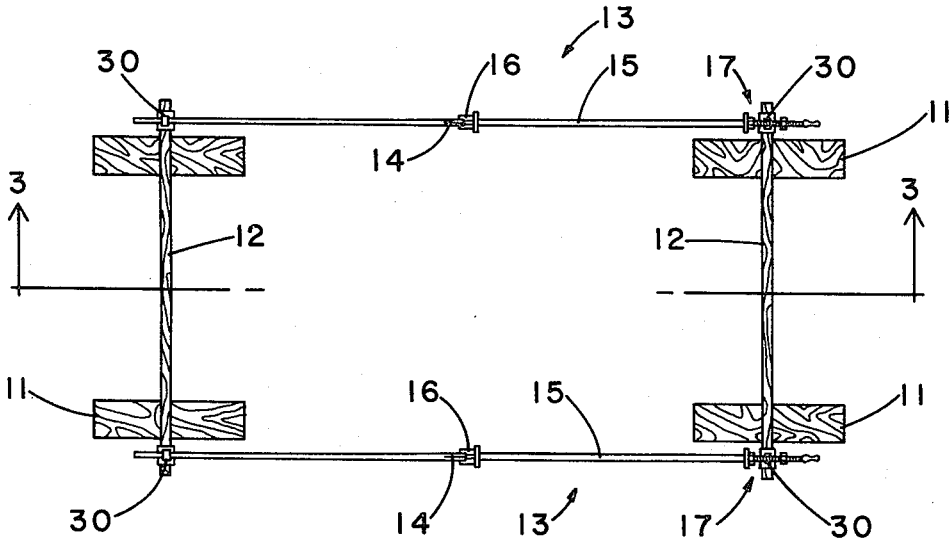
FIG. 2 is a top view of a portable clamping device.
Figure 3:
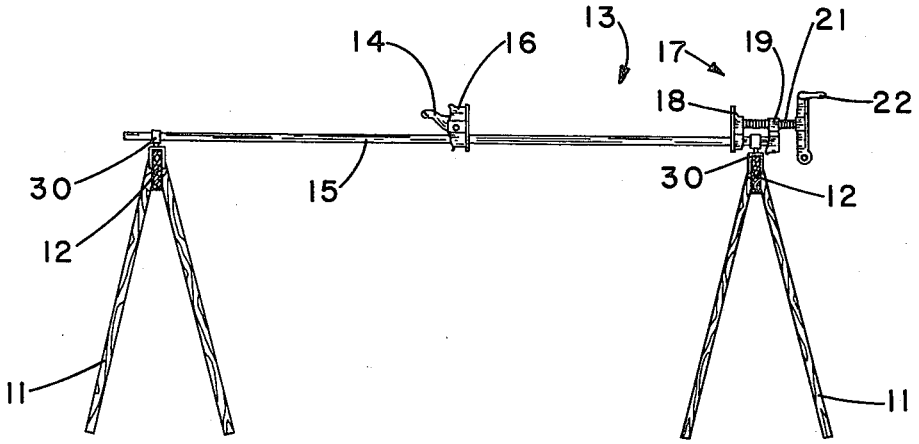
FIG. 3 is a cross sectional elevation view of the portable clamping device of FIG. 2.
Figure 4:
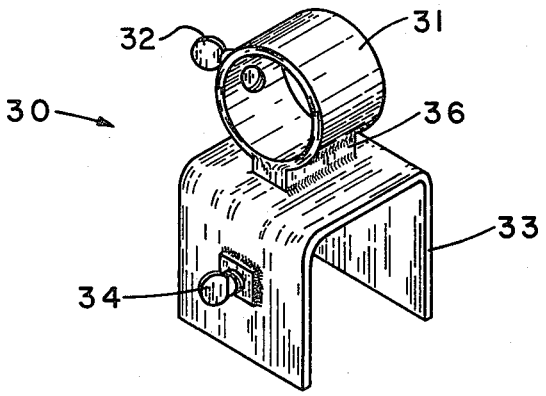
FIG. 4 is a perspective view of a pipe mounting device.
Figure 5:
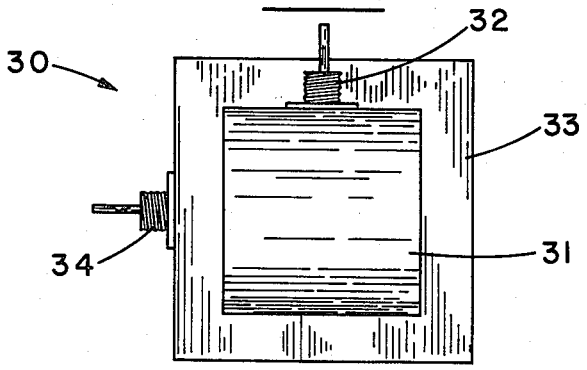
FIG. 5 is a top view of a pipe mounting device.
Figure 6:
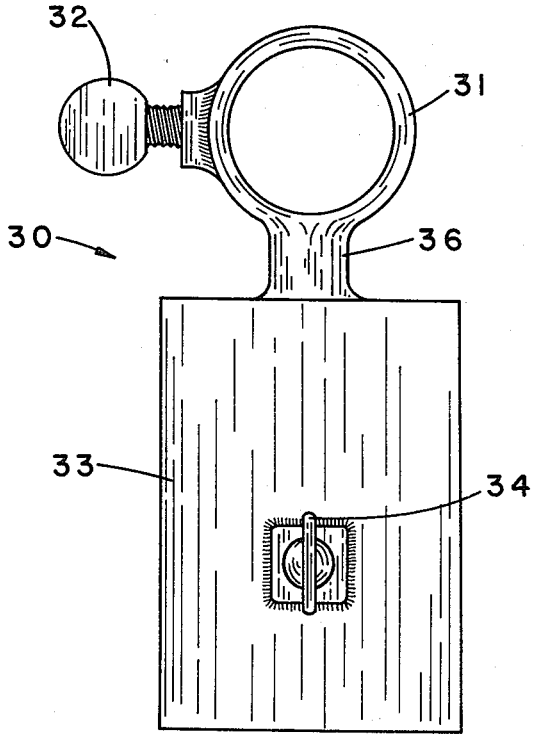
FIG. 6 is a side view of a pipe mounting device.
Figure 7:
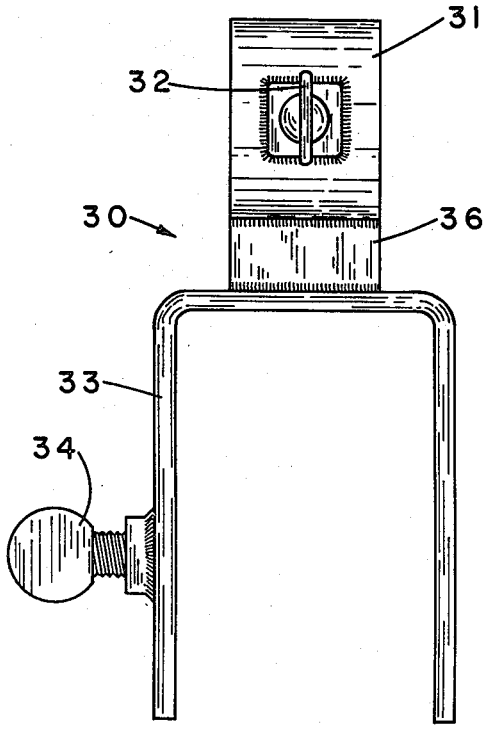
FIG. 7 is a front view of a pipe mounting device.

It may be seen from FIGS. 1 through 3 that the portable clamping device 10 of the present invention consists of pipe clamps 13 mounted on saw horses 11. Pipe clamps 13 are known in the art and are commonly referred to as "pony clamps." The pipe clamps 13 are mounted on the horizontal cross member 12 of the saw horse 11 with a pipe mounting device 30. Each pipe clamp 13 consists of a clamp locking end 16 and a clamp tightening end 17 mounted on a conventional pipe 15.

Figure 9:
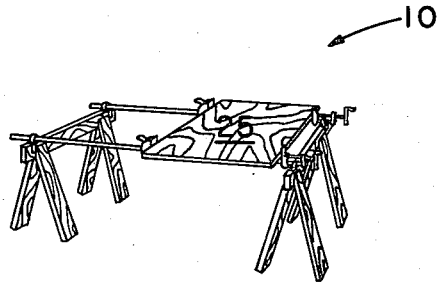
FIG. 9 is a perspective view of a portable clamping device holding a work piece in a horizontal position.
Figure 10:
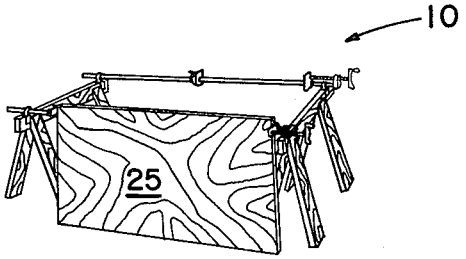
FIG. 10 is a perspective view of a portable clamping device holding a work piece in a vertical position.

The clamp locking end 16 is slideable and rotatable on the pipe 15 and may be locked into a desired position by use of a locking lever 14. A clamp tightening end 17 has a sliding plate 18 which is attached to a threaded plate 19 by means of an adjustment screw 21. The adjustment screw 21 is manually rotated with a handle 22 which is attached at one end. In the arrangement shown in FIGS. 1 through 3, the sliding plate 18 is both slideable and rotatable on the pipe 15, while the threaded plate 19 is rotatable on the pipe 15 but fixed with respect to sliding movement. The end of the adjustment screw 21 opposite the handle 22 is rotatably mounted on the sliding plate 18 and threading within the threaded plate 19 allows the sliding plate 18 to be moved with respect to the threaded plate 19 by rotation of the handle 22. Clamping is provided by first positioning the clamp locking end 16 at one surface of a work piece 25 and then tightening the sliding plate 18 against the opposite surface. FIG. 9 shows a work piece 25 held in a horizontal position by both clamps 13 of the device 10. FIG. 10 shows another use of the device 10 where the clamp locking end 16 and tightening end 17 had been rotated 90 degrees from the arrangement shown in FIG. 3 to provide clamping of a work piece 25 in a vertical position.

Figure 8:
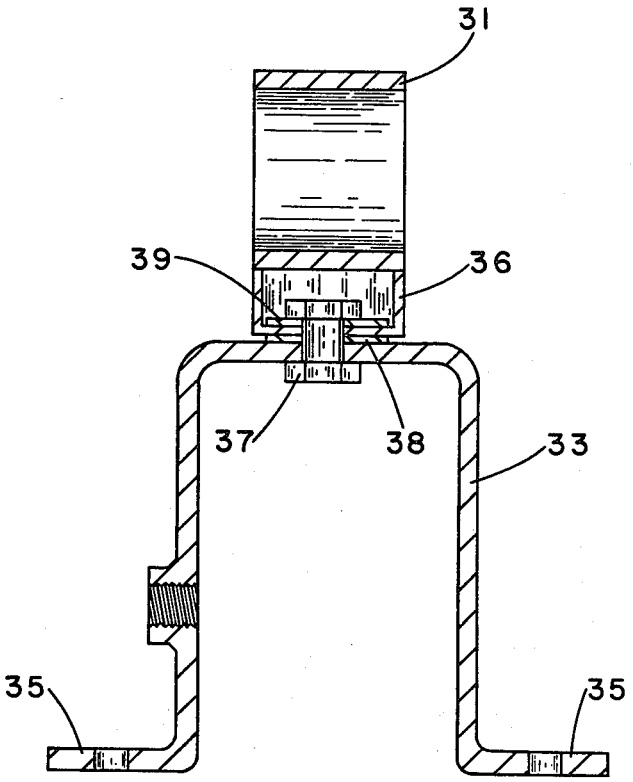
FIG. 8 is a front view of a pipe mounting device with a pivoting pipe holder and horizontal bracket flanges.
Figure 11:
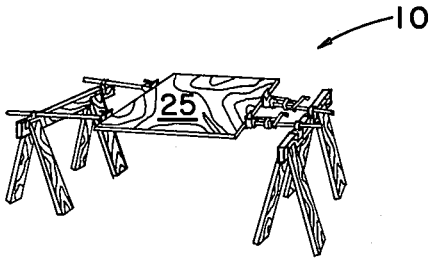
FIG. 11 is a perspective view of a portable clamping device showing non-parallel mounting of the pipe clamps.
Figure 12:
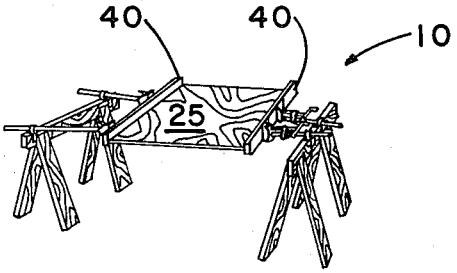
FIG. 12 is a perspective view of a portable clamping device showing elongate jaws mounted on the pipe clamps and used to secure a work piece.
Figure 13:
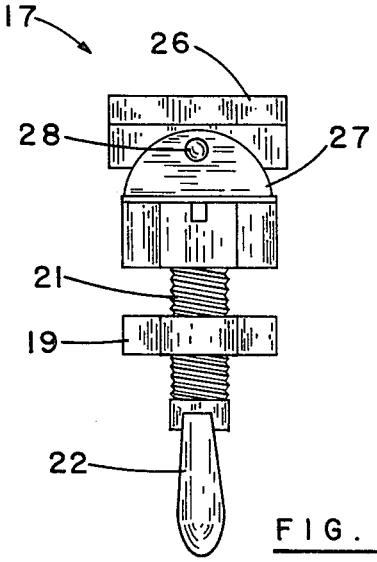
FIG. 13 is a top view of a pipe clamp holding piece showing a pivotal face.
Figure 14:
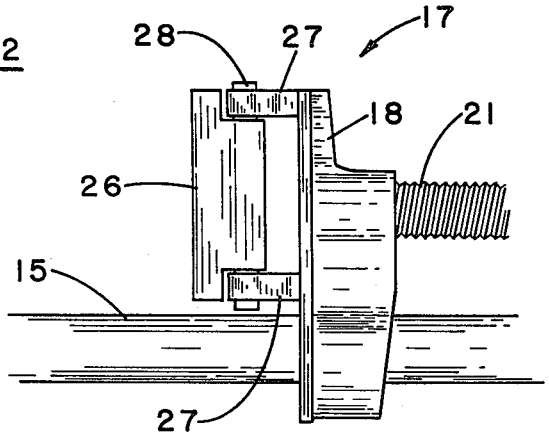
FIG. 14 is an elevation view of the pipe clamp holding piece shown in FIG. 13.

As shown in FIGS. 4–8, the pipe mounting device 30, which is used to mount a pipe 15 on a saw horse 11 consists generally of a pipe holder 31 mounted on a bracket 33. In the preferred embodiment the pipe holder 31 is a circular collar with an inside radius slightly larger than that of the outer radius of the pipe 15. A pipe thumb screw 32 mounted on threading in the pipe holder 31 may be used to hold the pipe 15 firmly in place. A mounting piece 36 which may be die cast, a separate metal piece, or entirely weldements is used to attach the pipe holder 31 to the upper surface of the bracket 33. To provide maximum stability for the portable clamping device 10, the pipe holder 31 is rigidly mounted on the bracket 33 to provide a right angle of alignment with the saw horse cross member 12. However, if it is desirable to be able to change the alignment of the pipe 15 or saw horse 11 from the parallel arrangement shown in FIGS. 1 through 3 and 9 through 10, the pipe holder 31 may be pivotally mounted on the bracket 33, as shown in FIG. 8. In this embodiment, the pivotal mounting is provided by a rivet 37 positioned in an aperture passing through the bracket 33 and a hollowed out mounting piece 36. Washers 38, 39 are provided at the surfaces of the mounting piece 36 to facilitate rotation. As shown in FIGS. 4 through 8, the brackets 33 may also be fitted with a thumb screw 34 or other hand operable tightening devices for firmly attaching the brackets 33 to the saw horse cross member 12. The width and depth of the bracket 33, may, of course, be varied to accommodate different size cross members 12 or other work stands, such as, for example, conventional chairs (not shown). As shown by FIG. 8, horizontal flanges 35 may be provided in the brackets 33 to allow the device 10 to be attached to a horizontal surface such as a table (not shown). In another embodiment of the present invention, the pipe holder 31 is mounted on the side rather than the top of the bracket 33 to facilitate clamping of the device 10 to opposite ends of a conventional table (not shown) or the like. When using a pipe mounting device 30 with the pivoting feature, as shown in FIG. 8, it is possible to position the pipes 15 in non-parallel relationship, as shown in FIGS. 11 and 12. FIGS. 11 and 12 also show that it is possible to position the pipe clamps 13 entirely between the cross pieces 12 to allow greater mobility in the movement of the clamps 13. As shown by FIG. 12, jaws 40, formed from two by four boards or the like, may be attached to the faces of the clamp locking end 16 and the clamp tightening end 17 to provide clamping pressure along an entire surface of a work piece 25, rather than just the clamp attachment points. The jaws 40 may be attached by bolting, riveting or other conventional means or may be used without surface attachment. In attaching work pieces 25 when the pipes 15 are in non-parallel alignment, as shown in FIGS. 11 and 12, or when a work piece 25 itself has an irregular surface, it may be desirable to employ a pipe clamp 13 having a pivotal face, as shown in FIGS. 13 & 14.

In another embodiment, four pipes 15 might be mounted on the saw horse 11 in a rectangular arrangement to provide clamping in two planes, rather than one. And in still another embodiment, pipe mounting devices 30 could be mounted vertically to provide pipes 15 positioned vertically at the four corners of the saw horses 11 to provide clamping in three planes. In the two and three plane embodiment, the pipe mounting might be provided by either adding additional pipe holders 31 to each bracket 33 or by merely increasing the number of pipe mounting devices 30.

Thus, it can be seen that a portable clamping device 10 has been described which provides an open adjustable table that can be adjusted in both width and length. By providing a swiveling type mounting device 30, the table may also be changed in shape. The portable clamping device 10 may also be provided with board jaw members 40 to convert it into a portable bench vice with independently adjustable jaws 40. The use of pipe clamps 13, which are rotatable on parallel pipes 15 allow a work piece 25 to be clamped in either a horizontal or vertical position. The open space at the upper surface of the device 10 allows a workman to glue and clamp along the bottom edge of the work piece 25, which would normally be resting on a solid surface. Since saw horses 11 may be easily constructed from material readily available at any construction site, the portable clamping device 10 may be easily carried from one job site to another because the pipe 15, pipe clamps 13 and pipe mounting devices 30 are compact and occupy little space.

We claim:

1. A portable clamping device for securely holding a work piece, comprising:

at least two elongated saw horses arranged in generally parallel transversely spaced apart relation, each saw horse including spaced apart pairs of legs and an upper cross bar connecting said pairs of legs, a pair of elongated pipes extending transversely between said saw horses for supporting a work piece thereon, pipe clamp means operatively mounted on each pipe for clamping a work piece supported on said pipes, and attachment means for attaching said pipes to said saw horses, said attachment means comprising a plurality of pipe holder means adapted for slidably receiving one end of one of said pipes, means releasably securing said pipe holder means at a selected axial position along a pipe, saw horse mounting means connected to said pipe holder means and comprising a generally inverted U-shaped bracket means adapted for placement onto a saw horse cross bar, and means for releasably securing said U-shaped bracket means at a selected position on said cross bar.

2. The portable clamping device of claim 1 wherein said pipe holder means comprises a generally annular collar means.

3. The portable clamping device of claim 1 wherein said means for releasably securing said pipe holder means comprises a first handscrew means on said pipe holder means and said means for releasably securing said U-shaped bracket means comprises a second handscrew means on said U-shaped bracket means.

4. The portable clamping device of claim 1 wherein said pair of pipes are positioned in said pipe holder means in perpendicular alignment with said saw horse cross bars in a plane parallel to the plane defined by said saw horse cross bars.

5. The portable clamping device of claim 1 wherein each pipe clamp means comprises a first piece and a second piece wherein said first piece and said second piece are positioned in slidably variable relationship on each pipe and wherein said first piece of each pipe clamp means is connected to a first jaw member and said second piece of each pipe clamp means is connected to a second jaw member whereby the device is provided with slidable jaws.

6. The portable clamp device of claim 1 wherein said pipe holder means is pivotally mounted on said saw horse mounting means.

* * * * *